US005951314A

United States Patent [19]

Durand-Cochet et al.

[11] Patent Number: 5,951,314

[45] Date of Patent: Sep. 14, 1999

[54] FEMALE ELECTRICAL CONTACT MEMBER

[75] Inventors: Fabrice Durand-Cochet, Rambouillet; Nicolas Deloge, Guyancourt, both of France

[73] Assignee: Connecteurs Cinch, Montigny le Bretonneux, France

[21] Appl. No.: 08/968,493

[22] Filed: Nov. 12, 1997

[30] Foreign Application Priority Data

Jan. 8, 1997 [FR] France ..... 97 00109

[51] Int. Cl.[6] ..... H01R 13/64

[52] U.S. Cl. ..... 439/252; 439/843

[58] Field of Search ..... 439/252, 246, 439/843

[56] References Cited

U.S. PATENT DOCUMENTS 2,870,424 1/1959 Franz ..... 439/252

5,611,717 3/1997 Joly .

5,702,272 12/1997 Machida ..... 439/843

FOREIGN PATENT DOCUMENTS 0678936 10/1995 European Pat. Off. .

*Primary Examiner*—Steven L. Stephan
*Assistant Examiner*—Javaid Nasri
*Attorney, Agent, or Firm*—Greenblum & Bernstein, P.L.C.

[57] ABSTRACT

Female electrical contact member includes a body with an arrangement at one end for receiving an electrical conductor and a receiving member for the elastic engagement of a complementary male electrical contact member. The body is extended by a bush open at its free end to provide a passage for the male member and the receiving member includes a ring extended towards the arrangement for receiving an electrical conductor by elastic tongues adapted to grip the male member. The ring slides and floats in the bush and is connected by a flexible electrical connection to the body, an arrangement being provided to limit sliding of the ring in the bush.

9 Claims, 8 Drawing Sheets

FEMALE ELECTRICAL CONTACT MEMBER

BACKGROUND OF THE INVENTION

1. Field of the Invention

The present invention concerns a female electrical contact member.

2. Description of the Prior Art

The invention concerns a female electrical contact member of the type having means at one end for fixing it to one end of an electrical conductor extended by a smaller cross-section intermediate part provided with means for receiving a male member.

These members are generally housed in passages of an electrical connector.

It has been found that if the connectors are disposed in locations where they are subject to vibration, for example in the vicinity of the engine compartment of a vehicle, slight displacement of the male members relative to the female members occurs and that this slippage leads to corrosion of the contact members.

One proposal for remedying these drawbacks is to provide connectors in which the electrical contact members are assembled without play, which makes fabrication complex and costly and complicates use.

Another proposal is to insert between the parts of the connectors subject to vibration and the contact members an elastic part in which the female contact members are formed. A member of this kind is complex to make because the elastic part must be highly flexible whereas the parts in contact must be closed to assure a good electrical connection, so that a highly specific and costly material has to be used for the fabrication.

One aim of the present invention is to provide a female electrical contact member that remedies these various drawbacks.

SUMMARY OF THE INVENTION

A female electrical contact member in accordance with the invention includes a body with means at one end for fixing it to an electrical conductor and a receiving member for the elastic engagement of a complementary male electrical contact member, wherein the body is extended by a bush open at its free end to provide a passage for the male member and the receiving member includes a ring extended towards the means for fixing to an electrical conductor by elastic tongues adapted to grip the male member, the ring sliding and floating in the bush and being connected by a flexible electrical connection to the body and means being provided to limit sliding of the ring in the bush.

With this arrangement, the body of the female electrical contact member can be subject to vibrations, little of which is transmitted to the ring; however, the latter vibrates without displacement relative to the male member, which prevents corrosion between the contact members.

In accordance with one particular feature of the invention the ring includes two opposite elastic tongues the free ends of which terminate in outwardly bent lips and abutments are cut into the bush and bent towards the interior of the bush with a disposition such that the lips bear against the abutments to limit sliding of the ring.

In a first embodiment the ring includes two further opposite elastic tongues having outwardly bent lateral strips to crimp one end of two flexible electrical conductors the other ends of which are fixed to the body.

In one variant of the invention the ring is extended on the same side as the fixing means to an electrical conductor by two strips bent into a zig-zag and the free ends of which are fixed to the body.

In another variant of the invention the bush is attached to the body. The female electrical contact member can then be made from two metals, one of which is a good conductor of electricity and the other of which has better mechanical qualities than the first.

In accordance with another constructional feature the body has at the end opposite that provided with means for fixing it to an electrical conductor a rectangular section part in the bottom of which is cut and bent a bearing surface for a flexible braid fixed to the ring, lugs being cut into the rectangular section that are adapted to be bent onto the flexible braid.

In accordance with another constructional feature of the latter variant, the bush has at one end a bar adapted to cooperate with the end of the body provided with the means for fixing it to an electrical conductor and terminating in lugs adapted to be crimped to the body, with an inwardly pressed portion in line with the bearing surface the edges of which coincide with the cut-out defining the bearing surface, a second inwardly pressed portion being formed in line with the rectangular section part from which are cut lugs adapted to be folded onto the flexible braid and the edges of which coincide with the cut-out defining the lugs.

This assembles the bush to the body in a very simple and rugged manner.

In accordance with another constructional feature the bush is extended by two strips one of which terminates in lugs for crimping a corresponding end of the flexible braid.

Finally, in accordance with a final feature of the invention the strips are connected by walls into each of which is cut an inwardly pressed portion adapted to cooperate with an abutment of the bush.

The invention will now be described in more detail with reference to specific embodiments shown by way of example only in the accompanying drawings.

DETAILED DESCRIPTION OF THE PREFERRED EMBODIMENTS

Figure 1:
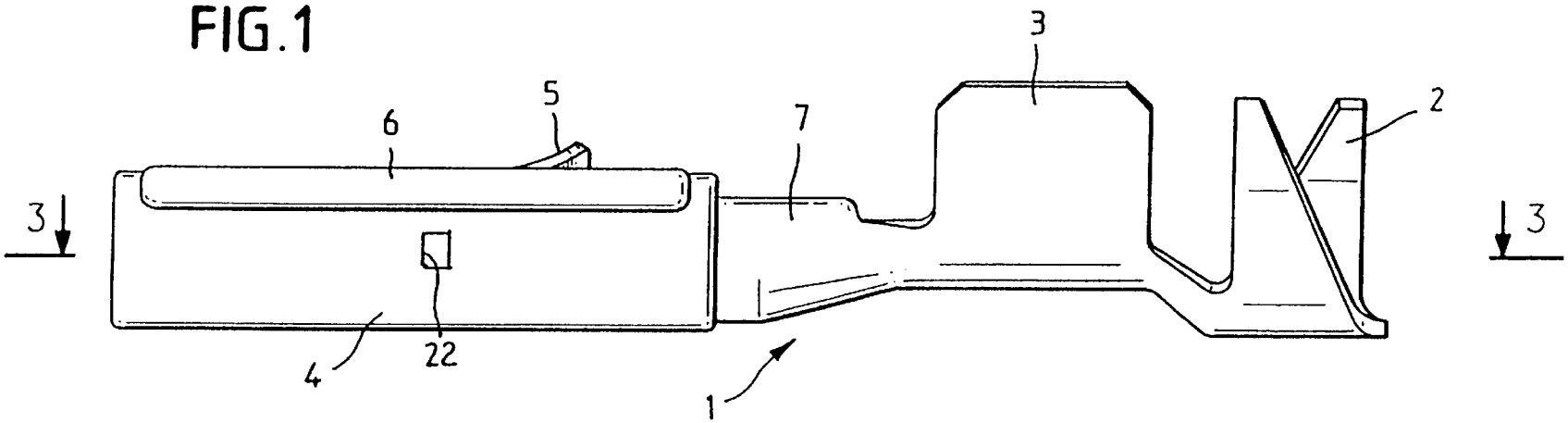
FIG. 1 is an elevation view of a female electrical contact member of the invention.
Figure 2:
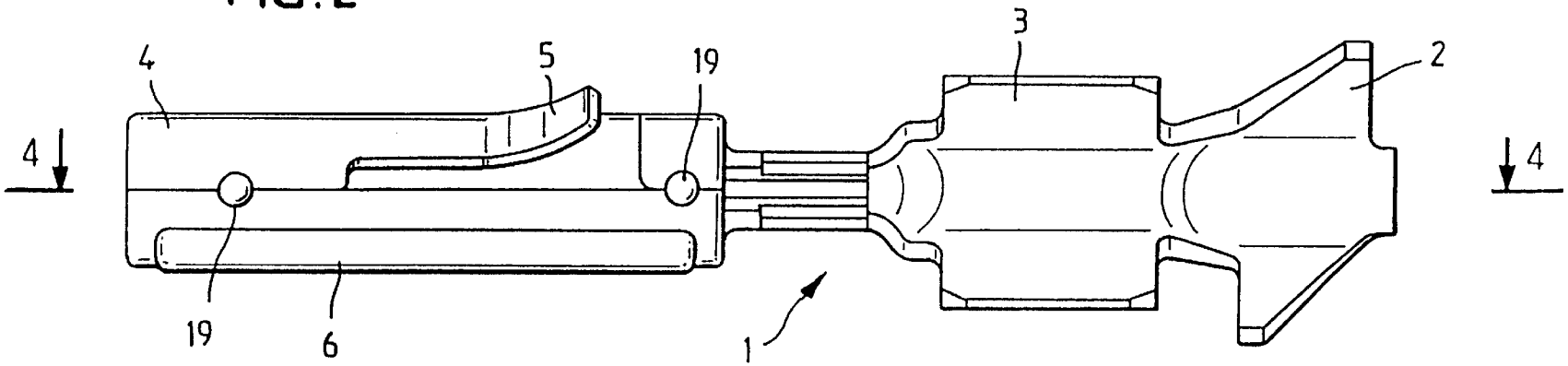
FIG. 2 is a plan view of the member from FIG. 1.

The female electrical contact member shown in the figures is made from a material that is a good conductor of electricity and has a body 1 cut and folded to shape from a metal blank having crimping lugs 2 and 3 at one end and a circular section bush 4 at the other end with a retaining tongue 5 for fixing it into a passage in a housing member of the connector and a boss 6 for guiding it in a groove of the passage. There is an intermediate part 7 between the bush 4 and the crimping lugs 3.

The bush 4 is rolled and the two edges are fixed by welds 19.

The free end of the bush 4 forms an opening 8 for insertion of a male member.

Figure 3:
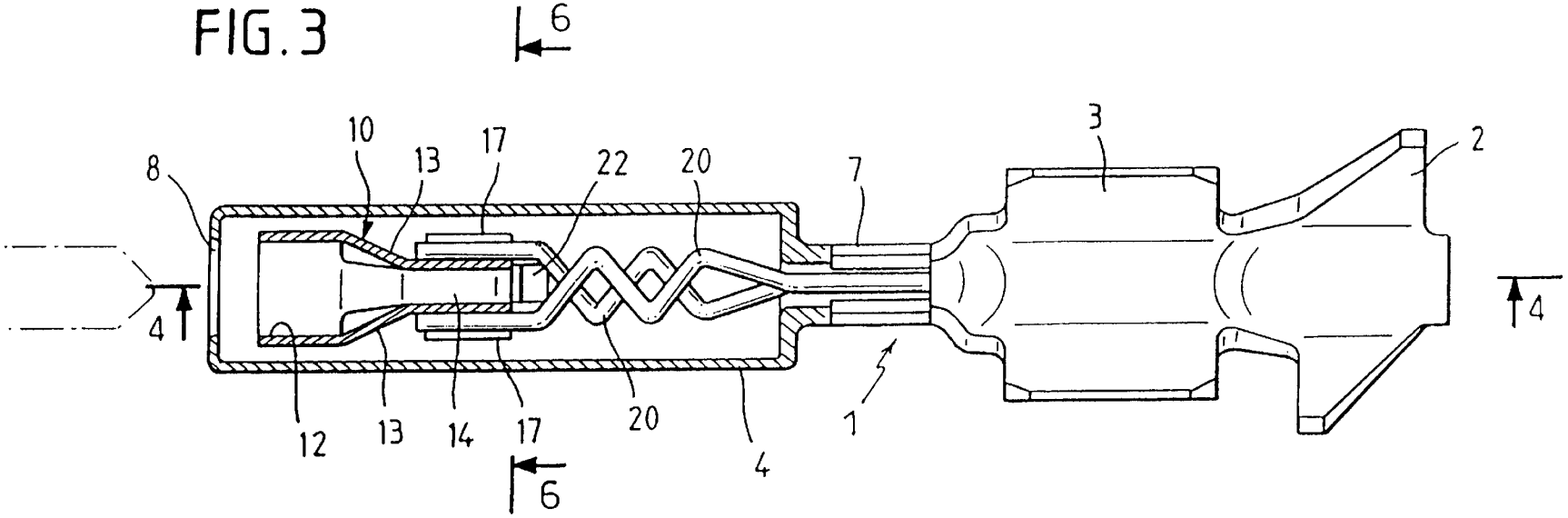
FIG. 3 is a view in section taken along the line 3—3 in FIG. 1.
Figure 4:
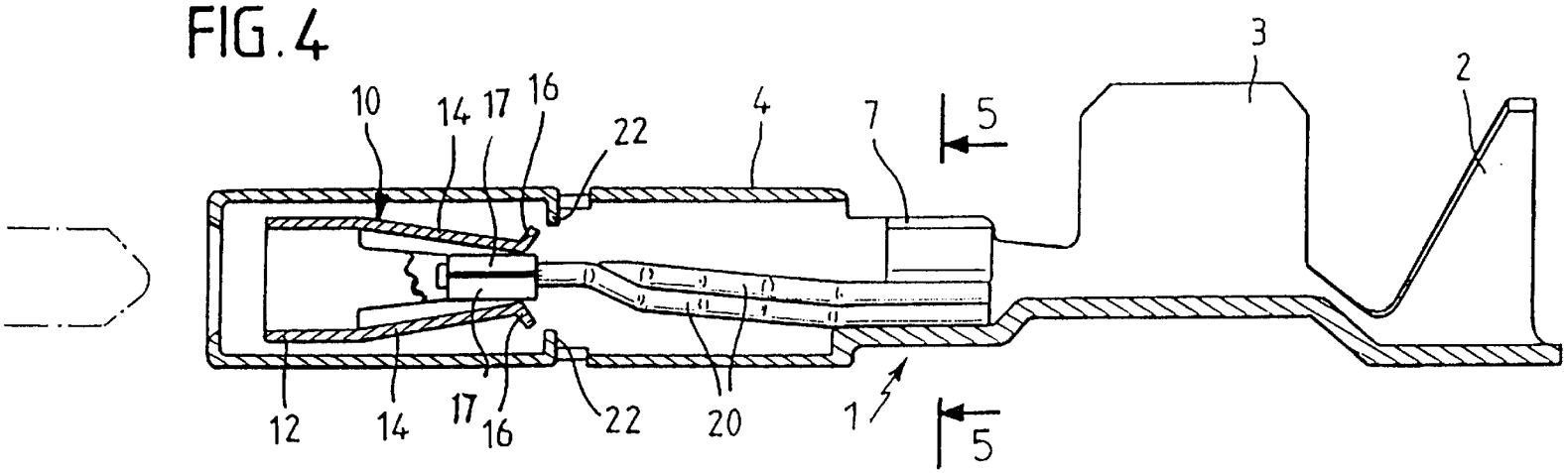
FIG. 4 is a view in section taken along the line 4—4 in FIG. 2.

As can be seen in FIGS. 3 and 4, a male member receiving member 10 is housed in the bush 4 and includes a ring 12 along one edge of which extend four tongues, two opposed tongues 13 and two opposed tongues 14.

The tongues 14 are curved to form an elastic clamp, the free ends terminating in outwardly bent lips 16.

Figure 5:
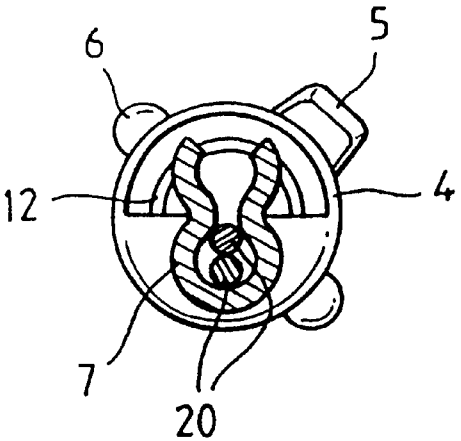
FIG. 5 is a view in section taken along the line 5—5 in FIG. 4.

The tongues 13 are curved, face each other and are extended laterally near their free end by outwardly bent strips 17 which are used to crimp one end of two electrical conductors 20, the other ends of which are fixed in the intermediate part 7 by soldering and by crimping (see FIG. 5) . The electrical conductors 20 are flexible conductors, for example with single wires or braided or twisted wires.

Two abutments 22 on the path of movement of the outwardly bent lips 16 are cut out from the bush 4.

When a male contact member (shown in chain-dotted line) is engaged in the ring 12, the male member abuts against the curved parts of the tongues 13 and 14 so that, the conductor 20 being flexible, the ring 12 slides in the bush 4 until the lips 16 bear against the abutments 22. As the male member is pushed further in, the tongues 13 and 14 spread to grip male member.

The electrical connection is made in this position and, because the connection between the male member and the ring 12 is perfectly rigid and the ring 12 is mounted floating, there is no relative displacement between the ring and the male member.

Figure 9:
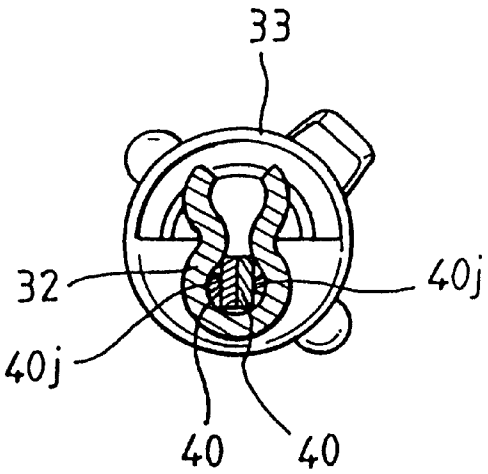
FIG. 9 is a view in section taken along the line 9—9 in FIG. 8.
Figure 6:
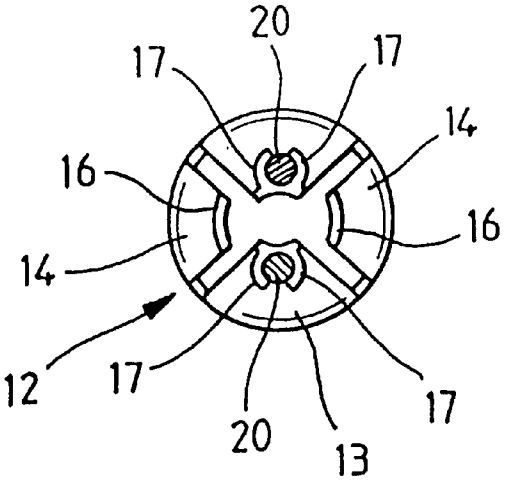
FIG. 6 is a view in section taken along the line 6—6 in FIG. 3.
Figure 7:
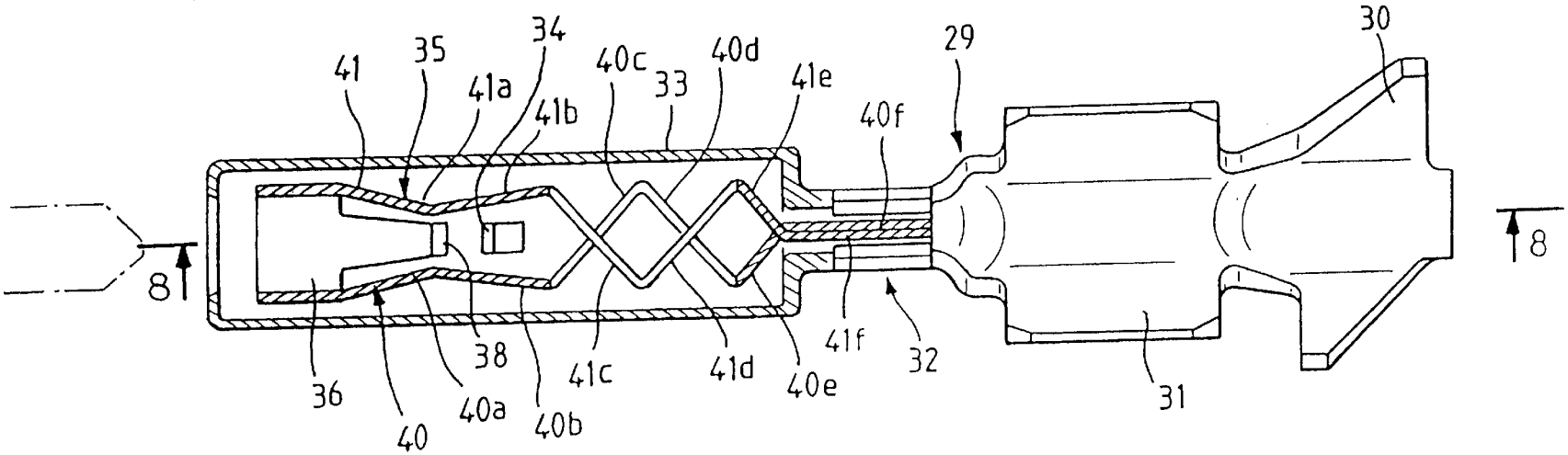
FIG. 7 is a sectional view corresponding to FIG. 3 of a different embodiment.
Figure 8:
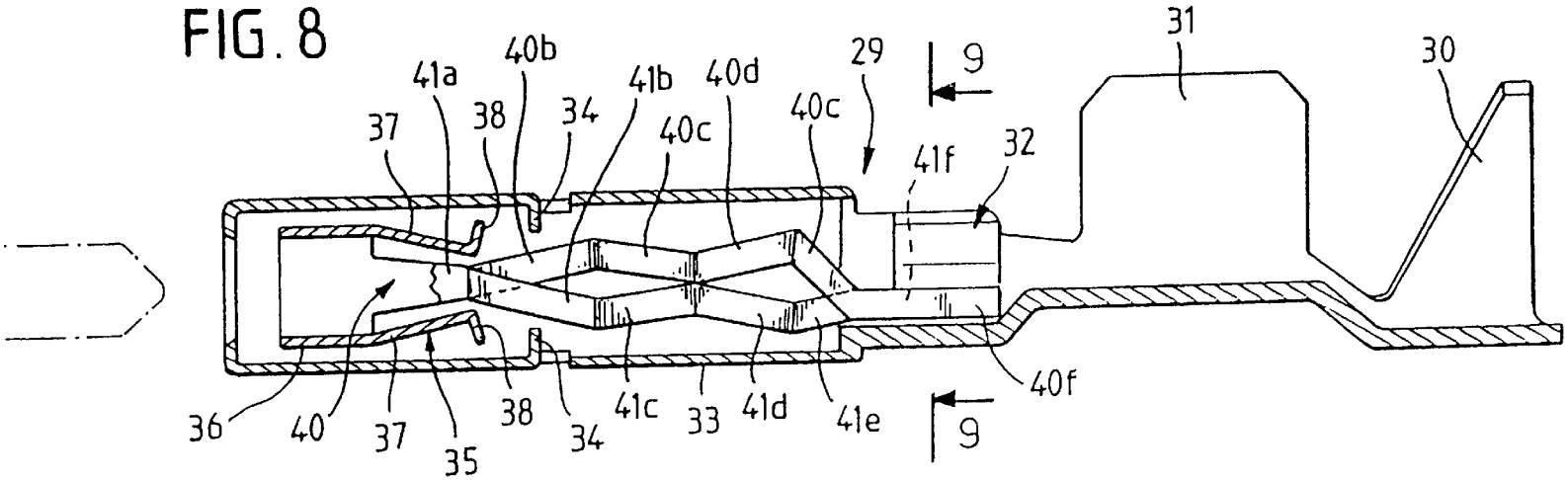
FIG. 8 is a view in section taken along the line 8—8 in FIG. 7.
Figure 10:
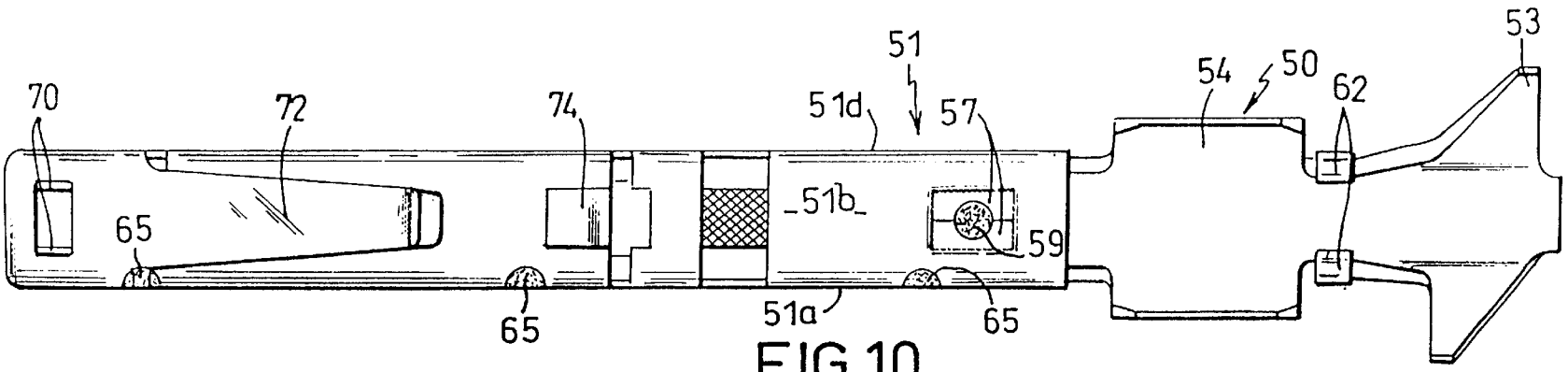
FIG. 10 is a plan view of a third embodiment of the invention.
Figure 11:
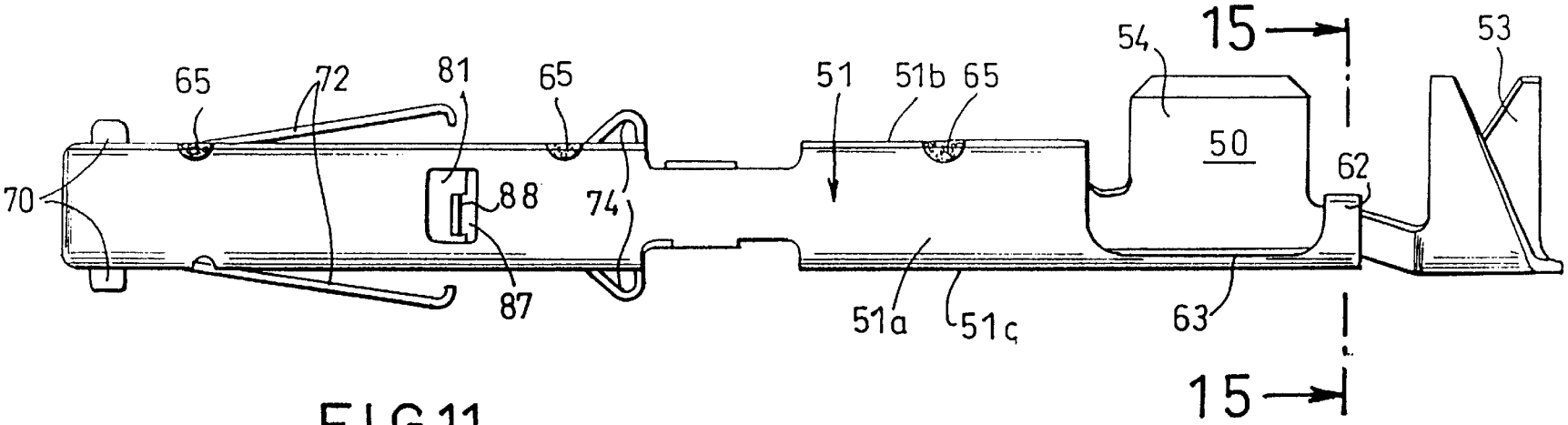
FIG. 11 is an elevation view of the female contact member from FIG. 10.
Figure 12:
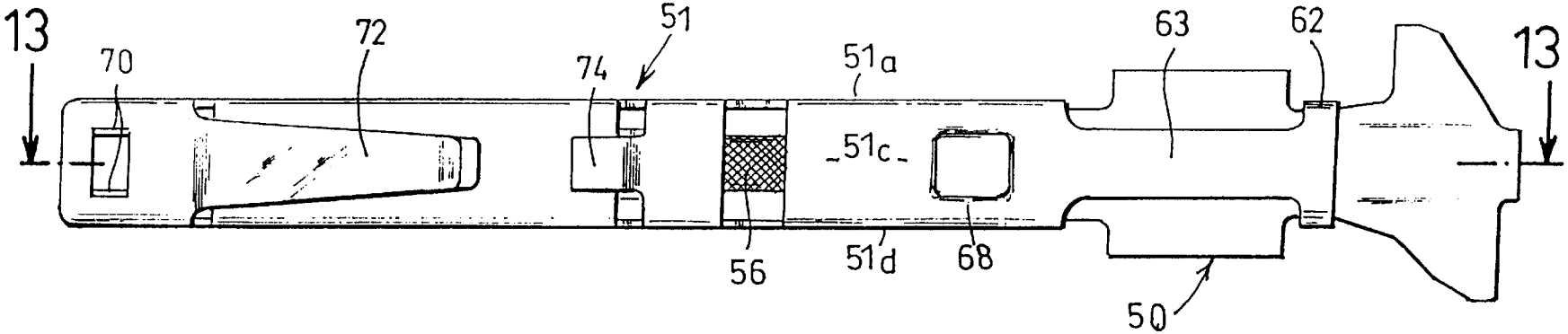
FIG. 12 is a bottom view of the female contact member from FIGS. 10 and 11.
Figure 13:
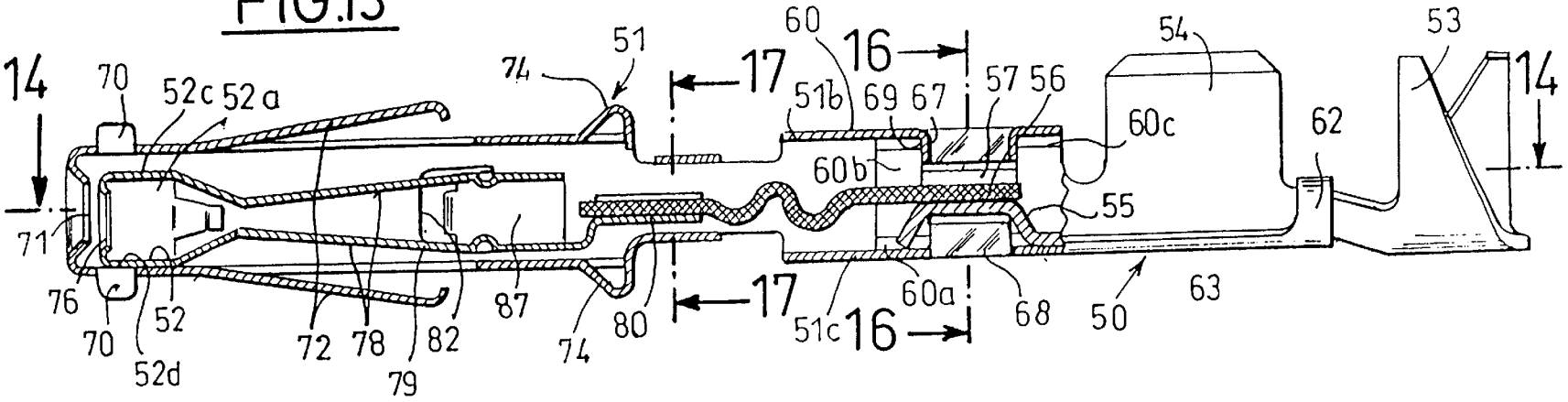
FIG. 13 is a view in section taken along the line 13—13 in FIG. 12.
Figure 14:
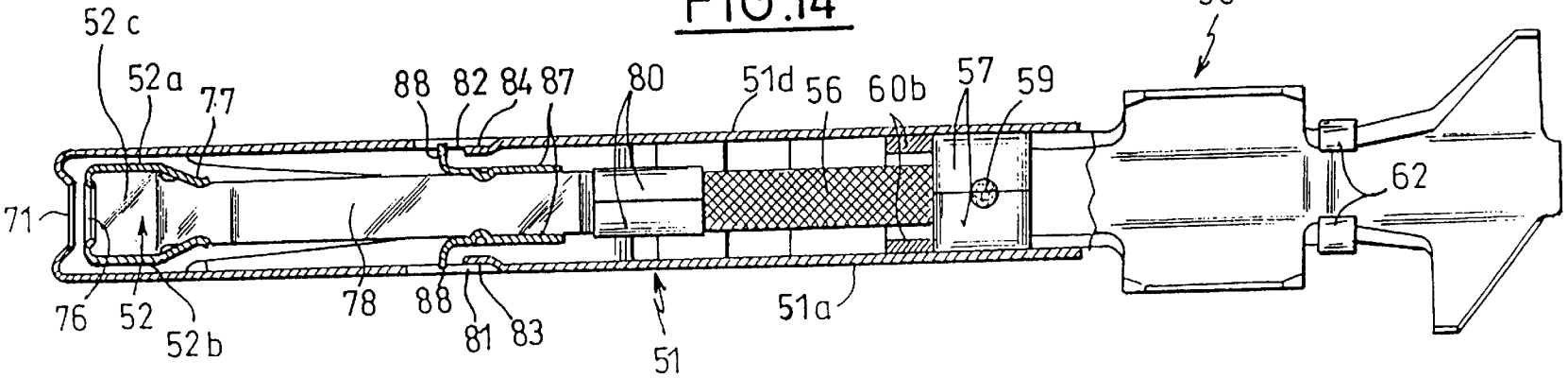
FIG. 14 is a view in section taken along the line 14—14 in FIG. 13.
Figure 15:
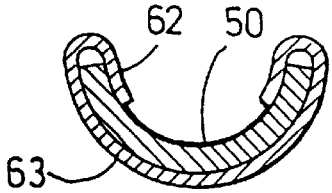
FIG. 15 is a view in section taken along the line 15—15 in FIG. 11.
Figure 16:
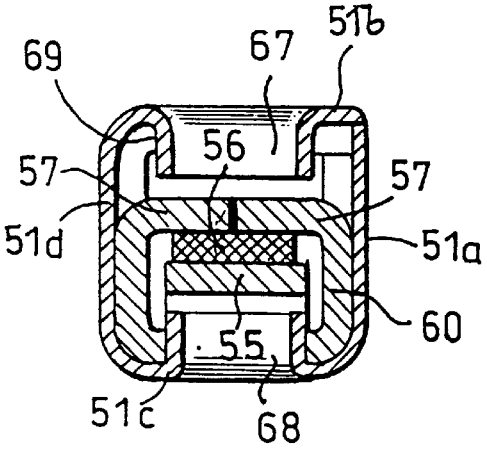
FIG. 16 is a view in section taken along the line 16—16 in FIG. 13.
Figure 17:
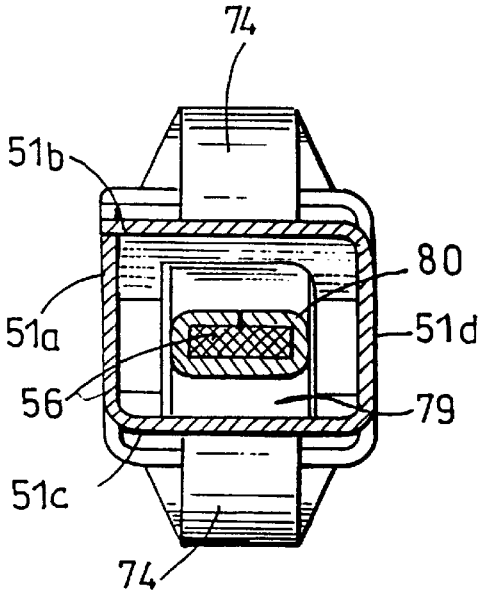
FIG. 17 is a view in section taken along the line 17—17 in FIG. 11.

FIGS. 7 through 9 show a different embodiment.

In this embodiment, the female electrical contact member is in the form of a body 29 having lugs 30 and 31 for crimping an electrical conductor at one end, an intermediate part 32 and a bush 33. These various members are cut and bent to shape from a strip of metal.

The bush 33 is made in the same way as the bush 4, with a retaining lug, a boss and two abutments 34.

The bush 33 houses a male member receiving member 35 that includes a ring 36 one end of which is extended by two tongues 37 the free ends of which terminate in a lip 38 adapted to bear against the abutments 34 upon engagement of the male contact member. The tongues 37 are curved towards each other in the direction towards their free end.

On the same side as the tongues 37, the ring 36 is extended by two strips 40 and 41. The strip 40 has a first section 40*a* inclined towards the free ends of the tongues 37, a second section 40*b* inclined in the opposite direction and sections 40*c*, 40*d* and 40*e* bent in a zig-zag and ending in a rectilinear section 40*f*.

The strip 41 is shaped to have a first section 41*a* inclined towards the section 40*a*, a second section 41*b* inclined in the opposite direction and sections 41*c*, 41*d* and 41*e* bent in a zig-zag and ending in a rectilinear section 41*f*. The zig-zag parts of the two strips are bent in opposite senses so as to form a kind of concertina; however, the first sections are offset one in one direction and the other in the opposite direction so that the zig-zag parts can cross without abutting against each other.

The ends 40*f* and 41*f* are welded into the intermediate part 32 which is crimped to the ends.

Thus the ring 36 is mounted to float in the bush 33.

Upon insertion of the male member, the male member abuts against the curved part of the tongues 37 and the sections 40*a* and 41*a*, so that the ring 36 is pushed into the bush 33 until the lips 38 cooperate with the abutments 34.

FIGS. 10 through 17 show a third embodiment of the invention.

The female electrical contact member in these figures is in three parts, namely a body 50, a bush 51 and a male member receiving member formed by a ring 52.

The body 50 includes crimping lugs 53 and 54.

On the side opposite the crimping lugs 53, 54 the body 50 is extended by a rectangular section part 60 with a bottom 60*a*, two lateral walls 60*b* and two lips 60*c*. A cut-out in the bottom 60*a* defines a bearing surface 55 for a braid 56. Two lugs 57 are cut out from the flanges 60*b* and the lips 60*c* for fixing the flexible braid 56 to the bearing surface 57, a spot weld 59 being made at the junction of the lugs 57.

The cut-out for the lugs 57 forms an opening 69 in the lips 60*c*.

The bush 51 is made from a metal having better mechanical qualities than the part 50 and has at one end a strip 63 terminating in two lugs 62 that are folded onto the body 50 in the gap between the crimping lugs 53 and 54.

On the side opposite the bar 63 the bush 51 is bent to a rectangular section with four sides 51*a*, 51*b*, 51*c* and 51*d*, the longitudinal edge of the side 51*b* coinciding with the longitudinal edge of the side 51*a*, these two edges being joined by spot welds 65.

The portion of the bush 51 in line with the lugs 57 is pressed inwardly at 67 so as to bend inwards the lugs that cooperate with the opening 69 in which the lugs 57 are cut.

The same portion of the bush 51 is stamped inwardly at 68, on the face 51*c*, the edges of this portion 68 coinciding with the opening cut into the part 60 to form the bearing surface 55. This anchors the bush 51 to the part 50.

Two lugs 70 are cut in the faces 51*b* and 51*c*, at the free end of the bush 51, and an opening 71 at the free end provides a passage for a complementary rectangular section male member.

Two retaining tongues 72 adapted to immobilize the female electrical contact member in a passage of a connector and two lips 74 that constitute shoulders to cooperate with a locking key, for example, are cut in the sides 51*b* and 51*c*, the lugs 70 forming polarizer means so that said members can be fitted only one way round.

The ring 52 has a substantially rectangular section with an opening 76 at one end corresponding to the opening 71 to receive the male member. Two opposite sides 52*a* and 52*b* of the ring 52 are cut and bent to form a kind of elastic clamp with elastic contact tongues 77 and the other two opposite sides 52*c* and 52*d* are extended by respective strips 78 and 79, said strip 79 terminating in two lugs 80 for crimping the corresponding end of the braid 56.

Holes 81 and 82 are formed in the respective walls 51*d* and 51*a* of the bush 51. The edge of each hole forms a boss that constitutes a respective abutment 83 and 84.

In the vicinity of the lugs 80 these strips 78 and 79 are joined by two plates 87 each of which has a lip 88, one of which engages in the hole 81 and the other in the hole 82. In this way the ring 52 is mounted free in the bush 51 between the free end of the bush 51 and the abutments 83 and 84.

When the male member is inserted it abuts against the elastic blade 77 and tends to push on the ring 52, sliding of which is limited by the abutments 83 and 84 in order for said male member to be inserted completely into the ring.

After fitting the male member, the ring and the male member remain fastened together with no displacement of one relative to the other under any conditions of use.

Of course, the invention is not limited to the embodiments shown that have just been described. Many modifications of detail can be made thereto without departing from the scope of the invention.

There is claimed:

1. A female electrical contact member, comprising:

a body extended by a bush, said bush comprising an open free end providing passage for a complementary male member;

a fixing member at one end of said body structured and arranged to fix said body to an electrical conductor;

a receiving member adapted for elastic engagement of the male member, said receiving member comprising a ring including elastic tongues extending towards said fixing member and adapted to grip the male member, said ring being constructed and arranged to slide and float in said bush, and is connected by a flexible electrical connection to said body; and a limiting member structured and arranged to limit sliding of said ring in said bush.

2. The female electrical contact member according to claim 1, wherein said elastic tongues include two opposite elastic tongues including free ends which terminate in outwardly bent lips; and said limiting member comprising abutments cut into said bush and bent towards an interior of said bush with a disposition such that said lips bear against said abutments to limit sliding of said ring.

3. The female electrical contact member according to claim 1, wherein said ring includes two further opposite elastic tongues including outwardly bent lateral strips to crimp one end of two flexible electrical conductors with the other ends of the two flexible electrical conductors being fixed to said body.

4. The female electrical contact member according to claim 1, wherein said ring is extended on the same side as said fixing member to an electrical conductor by two strips bent into a zig-zag including free ends which are fixed to said body.

5. The female electrical contact member according to claim 1, wherein said bush is attached to said body.

6. The female electrical contact member according to claim 5, wherein said body includes at the end opposite that including the fixing member a rectangular section part including a bottom of which is cut and bent a bearing surface for a flexible braid fixed to said ring, and lugs cut into said rectangular section adapted to be bent onto said flexible braid.

7. The female electrical contact member according to claim 6, wherein said bush includes at one end a strip adapted to cooperate with the end of said body including said fixing member, said strip terminating in lugs adapted to be crimped to said body, with an inwardly pressed portion in line with said bearing surface and including edges which coincide with the cut-out defining said bearing surface, a second inwardly pressed portion being formed in line with said rectangular section from which are cut lugs adapted to be folded onto said flexible braid and the edges of which coincide with the cut-out defining said lugs.

8. The female electrical contact member according to claim 5, wherein said bush is extended by two strips one of which terminates in lugs for crimping a corresponding end of a flexible braid.

9. The female electrical contact member according to claim 8, wherein said strips are connected by walls into each of which is cut an inwardly pressed portion adapted to cooperate with an abutment of said bush.

* * * * *